US011519408B2

(12) United States Patent
Daussin et al.

(10) Patent No.: US 11,519,408 B2
(45) Date of Patent: Dec. 6, 2022

(54) SCROLL COMPRESSOR INCLUDING A LUBRICATION SYSTEM PROVIDED WITH AN OIL STIRRING ARRANGEMENT

(71) Applicant: Danfoss Commercial Compressors, Trevoux (FR)

(72) Inventors: Arnaud Daussin, Trevoux (FR); David Genevois, Cailloux sur Fontaine (FR); Remi Bou Dargham, Villeurbanne (FR)

(73) Assignee: Danfoss Commercial Compressors, Trevoux (FR)

( * ) Notice: Subject to any disclaimer, the term of this patent is extended or adjusted under 35 U.S.C. 154(b) by 0 days.

(21) Appl. No.: 17/526,190

(22) Filed: Nov. 15, 2021

(65) Prior Publication Data

US 2022/0163036 A1 May 26, 2022

(30) Foreign Application Priority Data

Nov. 23, 2020 (FR) ..... 2012014

(51) Int. Cl.
*F03C 2/00* (2006.01)
*F03C 4/00* (2006.01)
(Continued)

(52) U.S. Cl.
CPC ..... *F04C 15/0088* (2013.01); *F04C 2/025* (2013.01); *F04C 2210/14* (2013.01);
(Continued)

(58) Field of Classification Search
CPC .. F04C 2/025; F04C 18/0215; F04C 15/0042; F04C 15/0088; F04C 23/008;
(Continued)

(56) References Cited

U.S. PATENT DOCUMENTS 4,702,681 A 10/1987 Inaba et al.
RE33,236 E * 6/1990 Hazaki ..... F04C 29/023 418/55.6
(Continued)

FOREIGN PATENT DOCUMENTS

FR 3062430 A1 8/2018
JP 5830402 A 2/1983
(Continued)

*Primary Examiner* — Theresa Trieu
(74) *Attorney, Agent, or Firm* — McCormick, Paulding & Huber PLLC

(57) ABSTRACT

The scroll compressor (1) includes a fixed scroll (7); an orbiting scroll (8); a support arrangement (5) including a thrust bearing surface (9) on which is slidably mounted the orbiting scroll (8); a rotation preventing device configured to prevent rotation of the orbiting scroll (8) with respect to the fixed scroll (7), the rotation preventing device including a plurality of orbital discs (28) respectively rotatably mounted in circular receiving cavities (29) provided on the support arrangement (5), each orbital disc (28) being provided with an outer circumferential bearing surface (31) configured to cooperate with an inner circumferential bearing surface (32) provided on the respective circular receiving cavity (29); and a lubrication system configured to lubricate the inner and outer circumferential bearing surfaces (32, 31) with oil supplied from an oil sump (36), the lubrication system including a plurality of oil reservoirs (43) each arranged in a bottom surface of a respective circular receiving cavity, and a plurality of oil stirring arrangements each configured to stir oil contained in a respective oil reservoir (43).

20 Claims, 2 Drawing Sheets

(51) Int. Cl.

| | |
|---|---|
| ***F04C 18/00*** | (2006.01) |
| ***F04C 2/00*** | (2006.01) |
| ***F04C 15/00*** | (2006.01) |
| ***F04C 2/02*** | (2006.01) |

(52) U.S. Cl.
CPC .... *F04C 2210/206* (2013.01); *F04C 2240/50* (2013.01); *F04C 2240/60* (2013.01); *F04C 2240/809* (2013.01)

(58) Field of Classification Search
CPC .... F04C 29/023; F04C 29/026; F04C 29/028; F04C 2210/14; F04C 2210/206; F04C 2240/50; F04C 2240/60; F04C 2240/807; F04C 2240/809; F01C 17/066; F01C 21/102
See application file for complete search history.

(56) References Cited

U.S. PATENT DOCUMENTS

| | | | | |
|---|---|---|---|---|
| 2007/0217934 | A1* | 9/2007 | Tateishi | F04C 18/0215 418/55.3 |
| 2015/0198159 | A1* | 7/2015 | Yamashita | F04C 29/023 418/55.6 |
| 2018/0216616 | A1* | 8/2018 | Daussin | F04C 18/0215 |
| 2020/0408208 | A1* | 12/2020 | Bron | F04C 18/0215 |

FOREIGN PATENT DOCUMENTS

| | | | |
|---|---|---|---|
| JP | 04365983 | A * | 12/1992 |
| WO | 2019240134 | A1 | 12/2019 |

* cited by examiner

SCROLL COMPRESSOR INCLUDING A LUBRICATION SYSTEM PROVIDED WITH AN OIL STIRRING ARRANGEMENT

CROSS-REFERENCE TO RELATED APPLICATION

This application claims foreign priority benefits under 35 U.S.C. § 119 to French Patent Application No. 2012014 filed on Nov. 23, 2020, the content of which is hereby incorporated by reference in its entirety.

TECHNICAL FIELD

The present invention relates to a scroll compressor, and in particular to a scroll refrigeration compressor.

BACKGROUND

JP 58-030402 A discloses a scroll compressor including:

- a fixed scroll comprising a fixed base plate and a fixed spiral wrap,
- an orbiting scroll including an orbiting base plate and an orbiting spiral wrap, the fixed spiral wrap and the orbiting spiral wrap forming a plurality of compression chambers,
- a drive shaft including a driving portion configured to drive the orbiting scroll in an orbital movement, the drive shaft being rotatable around a rotation axis,
- a support arrangement including a thrust bearing surface on which is slidably mounted the orbiting scroll,
- a rotation preventing device configured to prevent rotation of the orbiting scroll with respect to the fixed scroll and the support arrangement, the rotation preventing device including:
  - a plurality of orbital discs respectively rotatably mounted in circular receiving cavities provided on the support arrangement, each orbital disc being provided with an eccentric hole and with an outer circumferential bearing surface configured to cooperate with an inner circumferential bearing surface provided on the respective circular receiving cavity, and
  - a plurality of driving pins each including a first portion secured to the orbiting base plate and a second portion rotatably mounted in the eccentric hole of a respective orbital disc,
- an oil sump, and
- a lubrication system configured to lubricate at least partially the inner and outer circumferential bearing surfaces with oil supplied from the oil sump through a thrust bearing gap formed between the orbiting base plate and the support arrangement.

To ensure the lubrication of the inner and outer circumferential bearing surfaces at compressor start, spaces are arranged in the central region of the orbital discs to store oil. Lubrication passages and grooves may be formed in the bottom surfaces of the orbital discs or drilled through the orbital discs to further improve the oil supply to the inner and outer circumferential bearing surfaces.

Such concepts significantly increase the manufacturing costs of the scroll compressor.

Further, there may be lubrication issues at initial compressor startup, where not sufficient amount of oil is present in all spaces arranged in the central region of the orbital discs, which may harm the reliability and lifetime of the scroll compressor.

SUMMARY

It is an object of the present invention to provide an improved scroll compressor which can overcome the drawbacks encountered in conventional scroll compressors, and particularly which provide an improved lubrication of the rotation preventing device, especially the lubrication of the inner and outer circumferential bearing surfaces between the orbital discs and the circular receiving cavities.

Another object of the present invention is to provide a scroll compressor which has an improved reliability and lifetime compared to the conventional scroll compressors.

According to the invention such a scroll compressor includes:

- a fixed scroll comprising a fixed base plate and a fixed spiral wrap,
- an orbiting scroll including an orbiting base plate and an orbiting spiral wrap, the fixed spiral wrap and the orbiting spiral wrap forming a plurality of compression chambers,
- a drive shaft including a driving portion configured to drive the orbiting scroll in an orbital movement, the drive shaft being rotatable around a rotation axis,
- a support arrangement including a thrust bearing surface on which is slidably mounted the orbiting scroll,
- a rotation preventing device configured to prevent rotation of the orbiting scroll with respect to the fixed scroll and the support arrangement, the rotation preventing device including:
  - a plurality of orbital discs respectively rotatably mounted in circular receiving cavities provided on the support arrangement, each orbital disc being provided with an eccentric hole and with an outer circumferential bearing surface configured to cooperate with an inner circumferential bearing surface provided on the respective circular receiving cavity, and
  - a plurality of driving pins each including a first portion secured to the orbiting base plate and a second portion rotatably mounted in the eccentric hole of a respective orbital disc,
- an oil sump, and
- a lubrication system configured to lubricate at least partially the inner and outer circumferential bearing surfaces with oil supplied from the oil sump,
- wherein the lubrication system includes a plurality of oil reservoirs each arranged in a bottom surface of a respective circular receiving cavity, and a plurality of oil stirring arrangements each configured to stir oil contained in a respective oil reservoir, each oil stirring arrangement including at least one oil stirring element protruding into the respective oil reservoir.

Such a configuration of the lubrication system, and particularly the presence of the oil stirring arrangements, ensures a stirring of the oil contained in the oil reservoirs, and due to centrifugal effect, a proper lubrication of the outer circumferential bearing surfaces of the orbital discs, and therefore imparts to the scroll compressor according to the present invention an improved reliability and lifetime.

The scroll compressor may also include one or more of the following features, taken alone or in combination.

According to an embodiment of the invention, the at least one oil stirring element of each oil stirring arrangement is connected to a respective orbital disc and is configured to be moved within the respective oil reservoir, advantageously along a circular path, when the respective orbital disc is rotated in the respective circular receiving cavity.

According to an embodiment of the invention, the at least one oil stirring element of each oil stirring arrangement protrudes from a lower face of the respective orbital disc.

According to an embodiment of the invention, the at least one oil stirring element of each oil stirring arrangement is secured to a respective driving pin.

According to an embodiment of the invention, the at least one oil stirring element of each oil stirring arrangement and the respective driving pin are made in a single piece.

According to an embodiment of the invention, the at least one oil stirring element of each oil stirring arrangement is distinct from the respective driving pin and is attached to the respective driving pin.

According to an embodiment of the invention, the at least one oil stirring element of each oil stirring arrangement is formed by an elongated portion of the respective driving pin.

According to an embodiment of the invention, the at least one oil stirring element of each oil stirring arrangement is secured to the respective orbital disc.

According to an embodiment of the invention, the at least one oil stirring element of each oil stirring arrangement and the respective orbital disc are made in a single piece.

According to an embodiment of the invention, the at least one oil stirring element of each oil stirring arrangement is distinct from the respective orbital disc and is attached to the respective orbital disc.

According to an embodiment of the invention, each orbital disc is provided with a lower axial bearing surface configured to cooperate with an upper axial bearing surface provided on the bottom surface of the respective circular receiving cavity.

According to an embodiment of the invention, each upper axial bearing surface is provided in a central area of the bottom surface of the respective circular receiving cavity, and is surrounded by the respective oil reservoir.

According to an embodiment of the invention, each oil reservoir is annular.

According to an embodiment of the invention, the lubrication system includes a plurality of lubrication passages formed within the support arrangement, each lubrication passage including an oil outlet aperture emerging in the inner circumferential bearing surface of a respective circular receiving cavity.

According to an embodiment of the invention, each lubrication passage extends radially with respect to the rotation axis of the drive shaft.

According to an embodiment of the invention, each lubrication passage includes an oil inlet aperture emerging in the inner surface of the support arrangement, According to an embodiment of the invention, the inner surface of the support arrangement defines a receiving chamber in which the driving portion of the drive shaft is movably disposed.

According to an embodiment of the invention, the lubrication system further includes a circumferential groove provided on an inner surface of the support arrangement, the circumferential groove being configured to supply the lubrication passages with oil.

According to an embodiment of the invention, the lubrication system further includes an oil supplying channel fluidly connected to the oil sump and extending over at least a part of the length of the drive shaft, the lubrication passages being fluidly connected to the oil supplying channel.

According to an embodiment of the invention, the oil supplying channel emerges in an end face of the drive shaft oriented towards the orbiting scroll.

According to an embodiment of the invention, the orbiting scroll further includes a hub portion in which the driving portion of the drive shaft is at least partially mounted, the scroll compressor further including a counterweight connected to the driving portion and configured to at least partially balance the mass of the orbiting scroll.

According to an embodiment of the invention, the lubrication system further includes at least one oil supplying passage at least partially defined by the counterweight, the at least one oil supplying passage being configured to supply the thrust bearing surface and the lubrication passages with oil.

According to an embodiment of the invention, the counterweight includes a counterweight inner surface and a counterweight end surface respectively facing the hub portion and the orbiting base plate, the counterweight inner surface and the counterweight end surface at least partially defining the at least one oil supplying passage.

According to an embodiment of the invention, the counterweight inner surface and the counterweight end surface are respectively substantially complementary to respective contours of the hub portion and the orbiting base plate.

According to an embodiment of the invention, the at least one oil supplying passage is fluidly connected to the oil supplying channel.

According to an embodiment of the invention, the lubrication system includes an oil feeding passage provided on, and for example formed within, the driving portion of the drive shaft and fluidly connected to the oil supplying channel, the oil feeding passage being configured to supply the at least one supplying passage with oil.

According to an embodiment of the invention, the oil feeding passage includes a first end emerging in the end face of the drive shaft oriented towards the orbiting scroll and a second end emerging in an outer wall of the driving portion of the drive shaft facing the counterweight.

According to an embodiment of the invention, each circular receiving cavity emerges in the thrust bearing surface.

According to an embodiment of the invention, the support arrangement further includes a main bearing configured to guide in rotation a guided portion of the drive shaft, the lubrication system being configured to lubricate at least partially the main bearing with oil supplied from the oil sump.

According to an embodiment of the invention, the lubrication system further includes a lubrication hole provided on the drive shaft and fluidly connected to the oil supplying channel, the lubrication hole emerging in an outer wall of the guided portion of the drive shaft and facing the main bearing.

According to an embodiment of the invention, the at least one oil stirring element of each oil stirring arrangement extends substantially parallel to the rotation axis of the drive shaft.

According to an embodiment of the invention, the at least one oil stirring element of each oil stirring arrangement protrudes into the respective oil reservoir with a predetermined length which is greater than 50% of a depth of the respective oil reservoir, and for example greater than 70% of the depth of the respective oil reservoir.

According to an embodiment of the invention, each orbital disc is made of plastic material, e.g. comprising PEEK material, which has a light weight and excellent lubrication properties.

These and other advantages will become apparent upon reading the following description in view of the drawings attached hereto representing, as non-limiting example, an embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

In the description which follows, the same elements are designated with the same references in the different embodiments.

Figure 1:
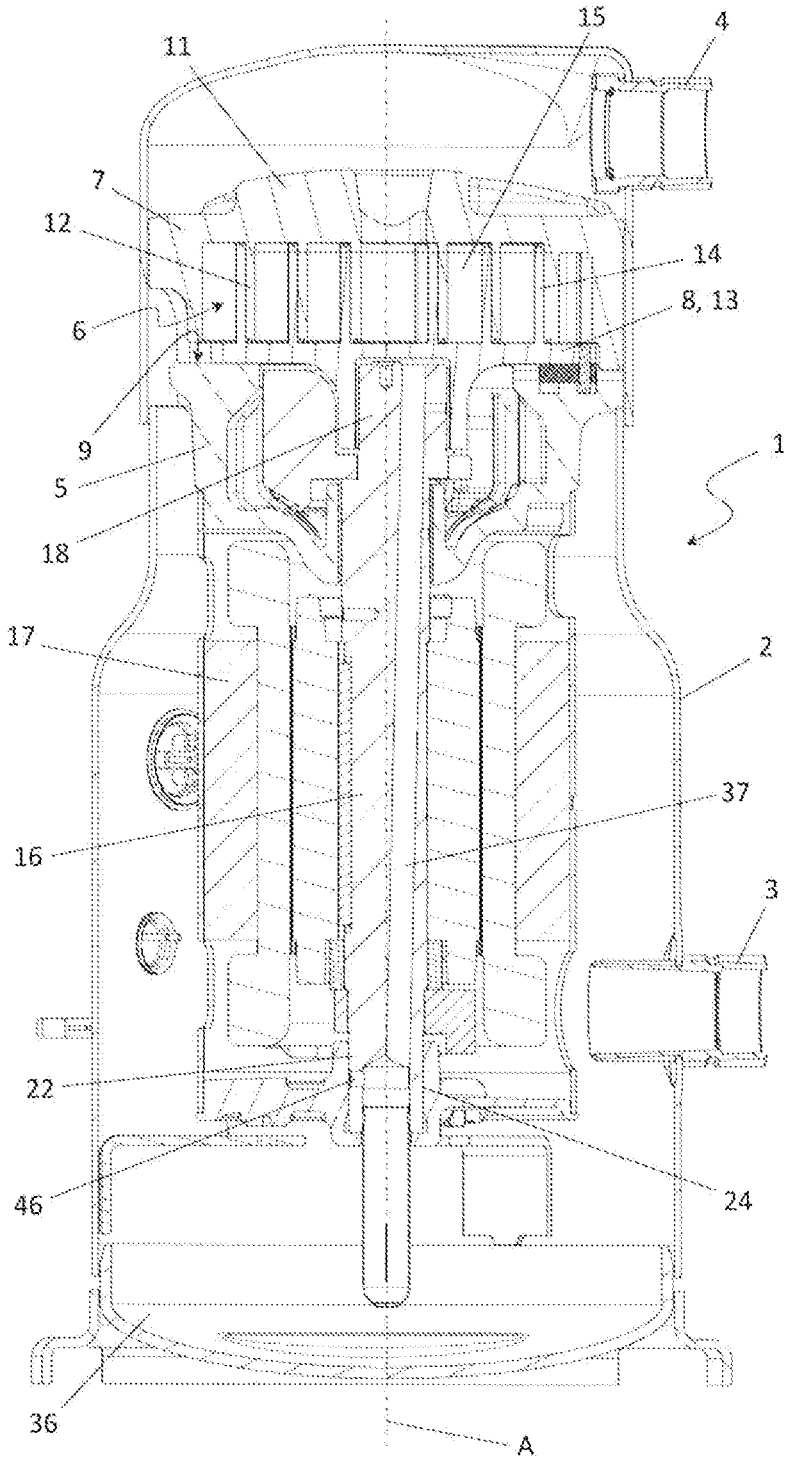
FIG. 1 is a longitudinal section view of a scroll compressor according to the invention.
Figure 2:
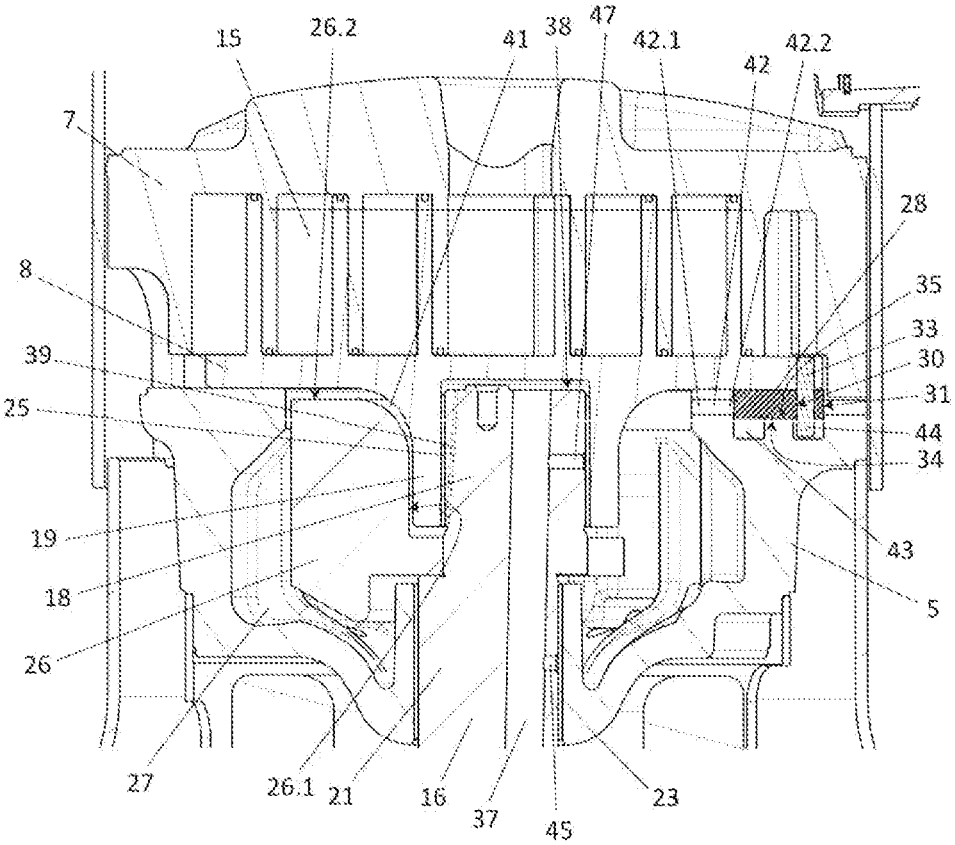
FIG. 2 is a partial longitudinal section view of the scroll compressor according to FIG. 1.
Figure 3:
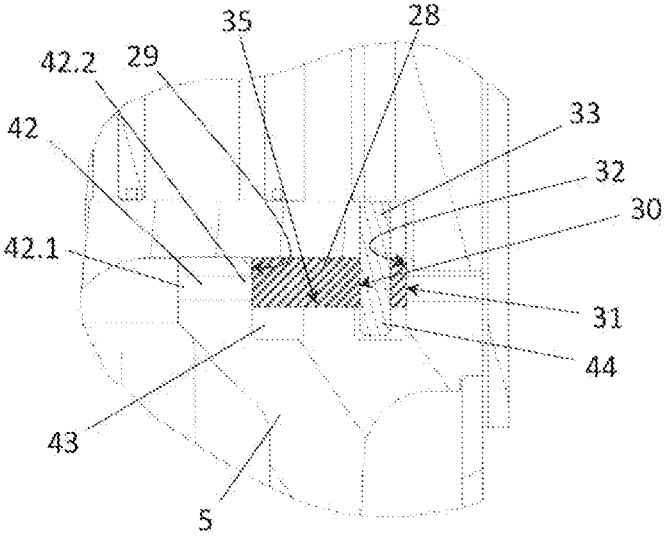
FIG. 3 is an enlarged view of a detail of FIG. 2.

FIG. 1 describes a scroll compressor 1 according to an embodiment of the invention occupying a vertical position.

The scroll compressor 1 includes a hermetic casing 2 provided with a suction inlet 3 configured to supply the scroll compressor 1 with refrigerant to be compressed, and with a discharge outlet 4 configured to discharge compressed refrigerant.

The scroll compressor 1 further includes a support arrangement 5 fixed to the hermetic casing 2, and a compression unit 6 disposed inside the hermetic casing 2 and supported by the support arrangement 5. The compression unit 6 is configured to compress the refrigerant supplied by the suction inlet 3. The compression unit 6 includes a fixed scroll 7, which is fixed in relation to the hermetic casing 2, and an orbiting scroll 8 supported by and in slidable contact with a thrust bearing surface 9 provided on the support arrangement 5.

The fixed scroll 7 includes a fixed base plate 11 having a lower face oriented towards the orbiting scroll 8, and an upper face opposite to the lower face of the fixed base plate 11. The fixed scroll 7 also includes a fixed spiral wrap 12 projecting from the lower face of the fixed base plate 11 towards the orbiting scroll 8.

The orbiting scroll 8 includes an orbiting base plate 13 having an upper face oriented towards the fixed scroll 7, and a lower face opposite to the upper face of the orbiting base plate 13 and slidably mounted on the thrust bearing surface 9. The orbiting scroll 8 also includes an orbiting spiral wrap 14 projecting from the upper face of the orbiting base plate 13 towards the fixed scroll 7. The orbiting spiral wrap 14 of the orbiting scroll 8 meshes with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

Furthermore, the scroll compressor 1 includes a drive shaft 16 configured to drive the orbiting scroll 8 in an orbital movement, and an electric driving motor 17, which may be for example a variable-speed electric driving motor, coupled to the drive shaft 16 and configured to drive in rotation the drive shaft 16 about a rotation axis A.

The drive shaft 16 includes, at its upper end, a driving portion 18 which is offset from the longitudinal axis of the drive shaft 16, and which is partially mounted in a hub portion 19 provided on the orbiting scroll 8. The driving portion 18 is configured to cooperate with the hub portion 19 so as to drive the orbiting scroll 8 in orbital movements relative to the fixed scroll 7 when the electric driving motor 17 is operated.

The drive shaft 16 also includes an upper guided portion 21 adjacent to the driving portion 18 and a lower guided portion 22 opposite to the first guided portion 21, and the scroll compressor 1 further includes an upper main bearing 23 provided on the support arrangement 5 and configured to guide in rotation the upper guided portion 21 of the drive shaft 16, and a lower main bearing 24 configured to guide in rotation the lower guided portion 22 of the drive shaft 16. The scroll compressor 1 also includes an orbiting scroll hub bearing 25 provided on the orbiting scroll 8 and arranged for cooperating with the driving portion 18 of the drive shaft 16.

Furthermore, the scroll compressor includes a counterweight 26 secured to the driving portion 18 and configured to at least partially balance the mass of the orbiting scroll 8. Particularly, the support arrangement 5 defines a receiving chamber 27 located above the upper main bearing 23 and in which the hub portion 19, the driving portion 18 and the counterweight 26 are movably disposed.

The scroll compressor 1 also includes a rotation preventing device configured to prevent rotation of the orbiting scroll 8 with respect to the fixed scroll 7 and the support arrangement 5. Particularly, the rotation preventing device includes:

- a plurality of orbital discs 28 respectively arranged in circular receiving cavities 29 formed in the support arrangement 5 and emerging in the thrust bearing surface 9, each orbital disc 28 being provided with an eccentric hole 30 and with an outer circumferential bearing surface 31 configured to cooperate with an inner circumferential bearing surface 32 provided on the respective circular receiving cavity 29, and
- a plurality of driving pins 33 each including a first portion unrotatably secured to the orbiting base plate 13 and a second portion rotatably mounted in and cooperating with the eccentric hole 30 of the respective orbital disc 28, each driving pin 33 being configured to drive in rotation the respective orbital disc 28 in the respective circular receiving cavity 29 when the drive shaft 16 drives the orbiting scroll 8 in an orbital movement.

Each orbital disc 28 is also provided with a lower axial bearing surface 34 configured to cooperate with an upper axial bearing surface 35 provided on the bottom surface of the respective circular receiving cavity 29.

According to the embodiment shown on the figures, the rotation preventing device includes three orbital discs 28 and three driving pins 33, the orbital discs 28 being angularly offset, and particularly regularly angularly offset, with respect to the rotation axis A of the drive shaft 16. Advantageously, each orbital disc 28 is made of plastic material, e.g. comprising PEEK material.

The scroll compressor 1 further comprises a lubrication system configured to lubricate at least partially the inner and outer circumferential bearing surfaces 31, 32, the lower and upper axial bearing surfaces 34, 35, as well as the sliding surfaces between eccentric holes 30 and driving pins 33 with oil supplied from an oil sump 36 defined by the hermetic casing 2, and particularly located at the bottom of the hermetic casing 2.

The lubrication system includes an oil supplying channel 37 formed within the drive shaft 16 and extending over the whole length of the drive shaft 16. The oil supplying channel 37 is configured to be supplied with oil from the oil sump 36.

According to the embodiment shown on the figures, the oil supplying channel 37 emerges in an end face 38 of the drive shaft 16 oriented towards the orbiting scroll 8.

The lubrication system may further include an oil feeding passage 39 provided on the driving portion 18 of the drive shaft 16 and fluidly connected to the oil supplying channel 37. According to the embodiment shown on the figures, the oil feeding passage 39 includes a first end emerging in the end face 38 of the drive shaft 16 and a second end emerging in an outer wall of the driving portion 18 facing the counterweight 26 in the area of the lower end of hub portion 19.

The lubrication system also includes an oil supplying passage 41 defined by the counterweight 26 and fluidly connected to the oil feeding passage 39. According to the embodiment shown on the figures, the counterweight 26 includes a counterweight inner surface 26.1 and a counterweight end surface 26.2 respectively facing the hub portion 19 and the orbiting base plate 13, and the counterweight inner surface 26.1 and the counterweight end surface 26.2 define the oil supplying passage 41. For example, the counterweight 26 may include an oil supplying groove provided on the counterweight inner surface 26.1 and on the counterweight end surface 26.2 and defining the oil supplying passage 41. Advantageously, the counterweight inner surface 26.1 and the counterweight end surface 26.2 are respectively substantially complementary to respective contours of the hub portion 19 and the orbiting base plate 13.

Furthermore, the lubrication system includes a plurality of lubrication passages 42 formed within the support arrangement 5 and fluidly connected to the oil supplying passage 41.

According to the embodiment shown on the figures, each lubrication passage 42 extends radially with respect to the rotation axis A of the drive shaft 16, and extends below the thrust bearing surface 9. Particularly, each lubrication passage 42 includes an oil inlet aperture 42.1 emerging in the inner surface of the support arrangement 5, and an oil outlet aperture 42.2 emerging in the inner circumferential bearing surface 32 of a respective circular receiving cavity 29.

The lubrication system further includes a plurality of oil reservoirs 43 each arranged in the bottom surface of a respective circular receiving cavity 29, and thus below a respective orbital disc 28. Advantageously, each circular receiving cavity 29 is provided with a respective oil reservoir 43.

According to the embodiment shown on the figure, each oil reservoir 43 is annular, and each upper axial bearing surface 35 is provided in a central area of the bottom surface of the respective circular receiving cavity 29, and is surrounded by the respective oil reservoir 43. Advantageously, each oil outlet aperture 42.2 emerges in the inner circumferential bearing surface 32 of the respective circular receiving cavity 29 at a location located above the respective oil reservoir 43.

In addition, the lubrication system includes a plurality of oil stirring arrangements each configured to stir oil contained in a respective oil reservoir 43.

Each oil stirring arrangement includes an oil stirring element 44 connected to a respective orbital disc 28 and protruding into the respective oil reservoir 43. Advantageously, each oil stirring element 44 protrudes from a lower face of the respective orbital disc 28, and is configured to be moved along a circular path within the respective oil reservoir 43 by the respective orbital disc 28 during rotation of the respective orbital disc 28 in the respective circular receiving cavity 29.

According to the embodiment shown on the figures, each oil stirring element 44 extends substantially parallel to the rotation axis A of the drive shaft 16, and protrudes into the respective oil reservoir 43 with a predetermined length which is greater than 50% of a depth of the respective oil reservoir 43, and for example greater than 70%, and advantageously greater than 80%, of the depth of the respective oil reservoir 43.

According to the embodiment shown on the figures, each oil stirring element 44 and the respective driving pin 33 are made in a single piece, and each oil stirring element 44 is formed by an elongated portion of the respective driving pin 33. However, according to another embodiment of the invention, each oil stirring element 44 could be distinct from the respective driving pin 33 and could be attached to the respective driving pin 33.

According to another embodiment of the invention, each oil stirring element 44 could be secured to the respective orbital disc 28. According to such an embodiment of the invention, each oil stirring element 44 and the respective orbital disc 28 could be made in a single piece, or each oil stirring element 44 could be distinct from the respective orbital disc 28 and could be attached to the respective orbital disc 28.

Moreover, according to the embodiment shown on the figures, the lubrication system is also configured to lubricate at least partially the upper and lower main bearings 23, 24 and the orbiting scroll hub bearing 25 with oil supplied from the oil sump 36. Therefore, the lubrication system further includes:

- a first lubrication hole 45 provided on the drive shaft 16 and fluidly connected to the oil supplying channel 37, the first lubrication hole 45 emerging in an outer wall of the upper guided portion 21 of the drive shaft 16 and facing the upper main bearing 23,
- a second lubrication hole 46 provided on the drive shaft 16 and fluidly connected to the oil supplying channel 37, the second lubrication hole 46 emerging in an outer wall of the lower guided portion 22 of the drive shaft 16 and facing the lower main bearing 24, and
- a third lubrication hole 47 provided on the drive shaft 16 and fluidly connected to the oil supplying channel 37, the third lubrication hole 47 emerging in an outer wall of the driving portion 18 of the drive shaft 16 and facing the orbiting scroll hub bearing 25.

When the electric driving motor 17 is operated and the drive shaft 16 rotates about its rotation axis A, oil from the oil sump 36 climbs into the oil supplying channel 37 of the drive shaft 16 due to centrifugal effect, and reaches the end face 38 of the drive shaft 16 after lubricating the lower main bearing 24, the upper main bearing 23, and the orbiting scroll hub bearing 25. At least a part of the oil having reached the end face 38 of the drive shaft 16 is evacuated towards the oil supplying passage 41 via the oil feeding passage 39 provided on the driving portion 18.

Then, due to centrifugal effect, oil flows in the oil supplying passage 41 and is directed towards the thrust bearing surface 9 and the lubrication passages 42 in order to lubricate at least partially the inner and outer circumferential bearing surfaces 31, 32 and the thrust bearing surface 9. Further to the oil originating from oil feeding passage 39, also oil leaving the lower end of orbiting scroll hub bearing 25 will enter the oil supplying passage 41 due to centrifugal effect.

During stop of the scroll compressor 1, an oil level in each circular receiving cavity 29 may decrease to the level of the oil outlet aperture 42.2 of the respective lubrication passage 42. Hence, a part of the inner and outer circumferential bearing surfaces 31, 32 may not be wetted with oil. The same applies for the sliding surfaces between eccentric holes 30 and driving pins 33.

As a stable supply of oil through each the lubrication passages 42 is ensured a few seconds after compressor start, the lubrication passages 42 do not ensure a proper lubrication of the inner and outer circumferential bearing surfaces 31, 32 at compressor start.

However, when the scroll compressor 1 is started, each oil stirring element 44 is displaced by the respective orbital disc 28 within the respective oil reservoir 43, which contains an adequate volume of oil, and stirs the oil contained in the respective oil reservoir 43. Such a stirring of the oil contained in each oil reservoir 43 ensures lubrication of the respective inner and outer circumferential bearing surfaces 31, 32 during the startup period of the scroll compressor 1 due to centrifugal effect, and thus avoid gripping of the inner and outer circumferential bearing surfaces 31, 32.

It should be noted that the presence of each oil reservoir 43 in the bottom surface of each circular receiving cavity 29 reduces the axial bearing surface between orbital disc and bottom of cavity. However, the remaining central axial bearing is sufficient, as the orbital discs are not subjected to large axial forces.

Of course, the invention is not restricted to the embodiment described above by way of non-limiting example, but on the contrary it encompasses all embodiments thereof. For example, each oil stirring arrangement may include several oil stirring elements 44 protruding into the respective oil reservoir 43.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A scroll compressor including:

a fixed scroll comprising a fixed base plate and a fixed spiral wrap, an orbiting scroll including an orbiting base plate and an orbiting spiral wrap, a drive shaft including a driving portion configured to drive the orbiting scroll in an orbital movement, the drive shaft being rotatable around a rotation axis (A), a support arrangement including a thrust bearing surface on which is slidably mounted the orbiting scroll, a rotation preventing device configured to prevent rotation of the orbiting scroll with respect to the fixed scroll and the support arrangement, the rotation preventing device including:

a plurality of orbital discs respectively rotatably mounted in circular receiving cavities provided on the support arrangement, each orbital disc being provided with an eccentric hole and with an outer circumferential bearing surface configured to cooperate with an inner circumferential bearing surface provided on the respective circular receiving cavity, and a plurality of driving pins each including a first portion secured to the orbiting base plate and a second portion rotatably mounted in the eccentric hole of a respective orbital disc, an oil sump, and a lubrication system configured to lubricate at least partially the inner and outer circumferential bearing surfaces with oil supplied from the oil sump, wherein the lubrication system includes a plurality of oil reservoirs each arranged in a bottom surface of a respective circular receiving cavity, and a plurality of oil stirring arrangements each configured to stir oil contained in a respective oil reservoir, each oil stirring arrangement including at least one oil stirring element protruding into the respective oil reservoir.

2. The scroll compressor according to claim 1, wherein the at least one oil stirring element of each oil stirring arrangement is connected to a respective orbital disc and is configured to be moved within the respective oil reservoir when the respective orbital disc is rotated in the respective circular receiving cavity.

3. The scroll compressor according to claim 1, wherein the at least one oil stirring element of each oil stirring arrangement protrudes from a lower face of the respective orbital disc.

4. The scroll compressor according to claim 1, wherein the at least one oil stirring element of each oil stirring arrangement is secured to a respective driving pin.

5. The scroll compressor according to claim 4, wherein the at least one oil stirring element of each oil stirring arrangement is formed by an elongated portion of the respective driving pin.

6. The scroll compressor according to claim 1, wherein the at least one oil stirring element of each oil stirring arrangement is secured to the respective orbital disc.

7. The scroll compressor according to claim 1, wherein each orbital disc is provided with a lower axial bearing surface configured to cooperate with an upper axial bearing surface provided on the bottom surface of the respective circular receiving cavity.

8. The scroll compressor according to claim 7, wherein each upper axial bearing surface is provided in a central area of the bottom surface of the respective circular receiving cavity, and is surrounded by the respective oil reservoir.

9. The scroll compressor according to claim 1, wherein each oil reservoir is annular.

10. The scroll compressor according to claim 1, wherein the lubrication system includes a plurality of lubrication passages formed within the support arrangement, each lubrication passage including an oil outlet aperture emerging in the inner circumferential bearing surface of a respective circular receiving cavity.

11. The scroll compressor according to claim 10, wherein each lubrication passage extends radially with respect to the rotation axis (A) of the drive shaft.

12. The scroll compressor according to claim 10, wherein the lubrication system further includes an oil supplying channel fluidly connected to the oil sump and extending over at least a part of the length of the drive shaft, the lubrication passages being fluidly connected to the oil supplying channel.

13. The scroll compressor according to claim 10, wherein the orbiting scroll further includes a hub portion in which the driving portion of the drive shaft is at least partially mounted, the scroll compressor further including a counterweight connected to the driving portion and configured to at least partially balance the mass of the orbiting scroll.

14. The scroll compressor according to claim 13, wherein the lubrication system further includes at least one oil supplying passage at least partially defined by the counterweight, the at least one oil supplying passage being configured to supply the thrust bearing surface and the lubrication passages with oil.

15. The scroll compressor according to claim 14, wherein the counterweight includes a counterweight inner surface and a counterweight end surface respectively facing the hub portion and the orbiting base plate, the counterweight inner surface and the counterweight end surface at least partially defining the at least one oil supplying passage.

16. The scroll compressor according to claim 2, wherein the at least one oil stirring element of each oil stirring arrangement protrudes from a lower face of the respective orbital disc.

17. The scroll compressor according to claim 2, wherein the at least one oil stirring element of each oil stirring arrangement is secured to a respective driving pin.

18. The scroll compressor according to claim 3, wherein the at least one oil stirring element of each oil stirring arrangement is secured to a respective driving pin.

19. The scroll compressor according to claim 2, wherein the at least one oil stirring element of each oil stirring arrangement is secured to the respective orbital disc.

20. The scroll compressor according to claim 3, wherein the at least one oil stirring element of each oil stirring arrangement is secured to the respective orbital disc.

* * * * *